US005581336A

United States Patent [19]

Matsuzaki et al.

[11] Patent Number: 5,581,336

[45] Date of Patent: Dec. 3, 1996

[54] DEVELOPING DEVICE PREVENTING SCATTERING OF DEVELOPING AGENT BY CONDUCTIVE MEMBER

[75] Inventors: Shigeru Matsuzaki, Yokohama; Yuji Sakemi, Inagi; Masami Izumizaki, Yokohama; Toshimitsu Danzuka, Tokyo, all of Japan

[73] Assignee: Canon Kabushiki Kaisha, Tokyo, Japan

[21] Appl. No.: 355,013

[22] Filed: Dec. 13, 1994

[30] Foreign Application Priority Data

| | | | |
|---|---|---|---|
| Dec. 17, 1993 | [JP] | Japan | 5-344213 |
| Jan. 12, 1994 | [JP] | Japan | 6-014804 |
| Mar. 25, 1994 | [JP] | Japan | 6-079348 |

[51] Int. Cl.[6] ..... G03G 15/09

[52] U.S. Cl. ..... 355/251; 118/657; 355/215

[58] Field of Search ..... 355/215, 245, 355/246, 251, 253; 118/653, 656, 657, 658

[56] References Cited

U.S. PATENT DOCUMENTS

| | | | |
|---|---|---|---|
| 3,991,713 | 11/1976 | Whited | 118/658 X |
| 4,338,880 | 7/1982 | Tabuchi et al. | 355/251 X |
| 4,615,608 | 10/1986 | Mizutani | 118/658 |
| 4,697,914 | 10/1987 | Hauser | 355/215 |
| 4,800,412 | 1/1989 | Ueda | 355/251 |
| 4,804,995 | 2/1989 | Osawa et al. | 355/253 |
| 4,954,404 | 9/1990 | Inoue et al. | 430/45 |

FOREIGN PATENT DOCUMENTS

| | | |
|---|---|---|
| 58-46365 | 3/1983 | Japan . |
| 60-95574 | 5/1985 | Japan . |
| 60-125863 | 7/1985 | Japan . |
| 4-51026 | 2/1992 | Japan . |

*Primary Examiner*—William J. Royer

*Attorney, Agent, or Firm*—Fitzpatrick, Cella, Harper & Scinto

[57] ABSTRACT

A developing device is provided with a developing container for accommodating developing agent including toner, a rotating developing agent carrier is arranged to face an image carrier carrying an electrostatic image for carrying the developing agent, and a conductive member is arranged along a longitudinal direction of the developing agent carrier with a spacing from the developing agent carrier. The conductive member is provided over longer than the longitudinal area of the developing agent carrier, and a voltage application circuit is employed for applying a voltage of the same polarity to a charging polarity of the toner to the conductive member.

15 Claims, 16 Drawing Sheets

DEVELOPING DEVICE PREVENTING SCATTERING OF DEVELOPING AGENT BY CONDUCTIVE MEMBER

BACKGROUND OF THE INVENTION

1. Field of the Invention

The present invention relates to a developing device used in an image forming apparatus such as a copying apparatus or a printer for developing an electrostatic image.

2. Related Background Art

FIG. 15 shows an example of a developing unit used in an electrophotographic apparatus.

In FIG. 15, a developing device 109 arranged to face a photoconductive drum 104 has a developing container 108, a developing sleeve 103 as developing agent carrying means, a developing agent return member 101 for defining a gathering part 105 for the developing agent and a blade 102 as a height defining member for the developing agent. An interior of the developing unit 109 is partitioned to a developing chamber (first chamber) 113 and an agitation chamber (second chamber) 114 by a wall 106 extending vertically, and the top of the wall 106 is open. Two-component developing agent including non-magnetic toner and magnetic carrier is accommodated in the developing chamber 113 and the agitation chamber 114, and the extra developing agent in the developing chamber 113 is collected into the agitation chamber 114.

First and second agitation screws 111 and 112 are arranged in the developing chamber 113 and the agitation chamber 114, respectively.

In the developing chamber 113 of the developing device 109, an opening is formed at a position corresponding to a developing area facing the photoconductive drum 104, and the developing sleeve 103 is rotatably arranged so as to be partially exposed to the opening. The developing sleeve 103 is made of a non-magnetic material and rotated in a direction of an arrow in FIG. 15 during a developing operation. A magnet (magnet roller) 110 which is a magnetic field generation means is fixed in the developing sleeve 103. The developing sleeve 103 carries the two-component developing agent having the layer height regulated by the blade 102 and supplies the developing agent to the photoconductive drum 104 in the developing area facing the photoconductive drum 104 to develop a latent image. In order to improve the developing efficiency, a developing bias voltage having an AC voltage superimposed on a DC voltage is applied from a power supply 115 to the developing sleeve 103.

According to the construction mentioned above, the developing device 109 holds the developing agent supplied to the surface of the developing sleeve 103 by the agitation screws 111 and 112 in a state of magnetic brush by the magnetic force of the magent roller 110, and carries it to the area facing the photoconductive drum 104 (developing area) by the rotation of the developing sleeve 103, and cuts the magnetic brush by the developing agent return member 101 and the blade 102 to properly maintain the amount of developing agent carried into the developing area.

More particularly, the magnet roller 110 of the conventional developing device is of 5-pole construction, and the developing agent agitated by the developing chamber agitation screw 111 is bound by the magnetic force of a carrying magnetic pole (pumping pole) S2 for pumping and it is carried to the developing agent gathering part 105 by the rotation of the developing sleeve 103. The amount of the developing agent is regulated by the developing agent return member 101 and sufficiently bound by a carrying magnetic pole (cut pole) N2 having a predetermined or higher magnetic flux density to bind stable developing agent, and carried while forming the magnetic brush. The magnetic brush is then cut by the blade or the height regulation member 102 to maintain the proper amount of developing agent, and the developing agent is carried by a carrying magnetic pole S1. The bias voltage having the DC and/or AC voltage superimposed is applied to the developing sleeve 103 through the bias power supply 115 provided in the image forming apparatus at a developing pole N1, and the toner on the developing sleeve 103 is moved toward the electrostatic latent image, which is visualized as a toner image.

In such a developing device, a portion of the toner or the developing agent scatters as the developing sleeve 103 is rotated to contaminate the image or deposit on other equipments nearby, which causes various troubles. Various approaches have been adapted in the past to prevent such scattering.

In the example of FIG. 15, a magnetic plate 123 is arranged in the vicinity of a carrying magnetic pole (take-in pole) S3 to form a magnetic curtain by the developing agent to prevent the scattering. In Japanese Laid-Open Patent Application No. 4-6949, the conductive member which is close to the photoconductive drum is electrically insulated and arranged at a developing agent supply port of the developing device to form an electric field curtain to prevent the scattering of the toner. In Japanese Laid-Open Patent Application No. 4-51026, an electrode member is provided at a portion of the developing sleeve which is close to the photoconductive drum to generate a uni-directional electric field between the electrode member and the developing sleeve.

However, in the magnetic curtain by the magnetic plate, a sufficient magnetic curtain for preventing the scattering may not be formed when the magnetic flux density of the carrying magnetic pole S3 is not sufficiently large, or it is not effective for the scattering generated in the developing pole N1 from the S3 pole.

In the method disclosed in Japanese Laid-Open Patent Application No. 4-6949, the suppression of the scattering to the longitudinally opposite ends of the developing device, that is, to the front end and the rear end, is not effective.

In the method disclosed in Japanese Laid-Open Patent Application No. 4-51026, the electric field established by the electrode member downstream of the developing area as viewed in the direction of rotation of the sleeve may be directed to the developing area and the scattering near the take-in port of the developing agent cannot be perfectly suppressed.

Japanese Laid-Open Patent Application No. 58-46365, Japanese Laid-Open Patent Application No. 60-95574 and Japanese Laid-Open Patent Application No. 60-125863 disclose to apply a voltage of the same polarity as that of the toner to the electrode, but the effect of suppressing the scattering is not sufficient.

SUMMARY OF THE INVENTION

It is an object of the present invention to provide a developing device which prevents the scattering of toner from a developing container.

It is another object of the present invention to provide a developing device comprising:

a developing container for accommodating developing agent including toner;

a rotating developing agent carrier arranged to face an image carrier which carries an electrostatic image for carrying the developing agent;

a conductive member arranged along a longitudinal direction of the developing agent carrier with a spacing from said developing agent carrier;

the conductive member being provided over longer than the longitudinal area of the developing agent carrier; and voltage application means for applying a voltage of the same polarity to a charging polarity of the toner to the conductive member.

It is another object of the present invention to provide a developing unit comprising:

a developing container for accommodating developing agent including toner;

a rotating developing agent carrier arranged to face an image carrier which carries an electrostatic image for carrying the developing agent;

magnetic field generation means arranged in the developing agent carrier for carrying the developing agent by a magnetic force;

the magnetic field generation means including a first magnetic pole and a second magnetic pole having the same polarity as that of the first magnetic pole and adjacent to the first magnetic pole in the downstream direction as viewed in the direction of movement of said developing agent carrier;

a layer thickness regulation member arranged downstream of said second magnetic pole as viewed in the direction of movement of the developing agent carrier for regulating the thickness of the developing agent layer on the developing agent carrier;

a conductive member arranged downstream of the regulation station of the layer thickness regulation member and upstream of the first magnetic pole as viewed in the direction of movement of the developing agent carrier and having a spacing from the developing agent carrier and arranged along the longitudinal direction of the developing agent carrier; and voltage application means for applying a voltage of the same polarity as the charging polarity of the toner to the conductive member.

It is another object of the present invention to provide a developing unit comprising:

a developing container for accommodating developing agent including toner;

a rotating developing agent carrier arranged to face an image carrier which carries an electrostatic image for carrying the developing agent;

magnetic field generation means arranged in the developing agent carrier for carrying the developing agent by a magnetic force; and a conductive member arranged along the longitudinal direction of said developing agent carrier with a spacing from the developing agent carrier;

the conductive member being arranged such that at least a portion thereof faces an area in which a magnetic flux density normal to the surface of the developing agent carrier is smaller than a horizontal magnetic flux density.

DETAILED DESCRIPTION OF THE PREFERRED EMBODIMENTS

Figure 14:
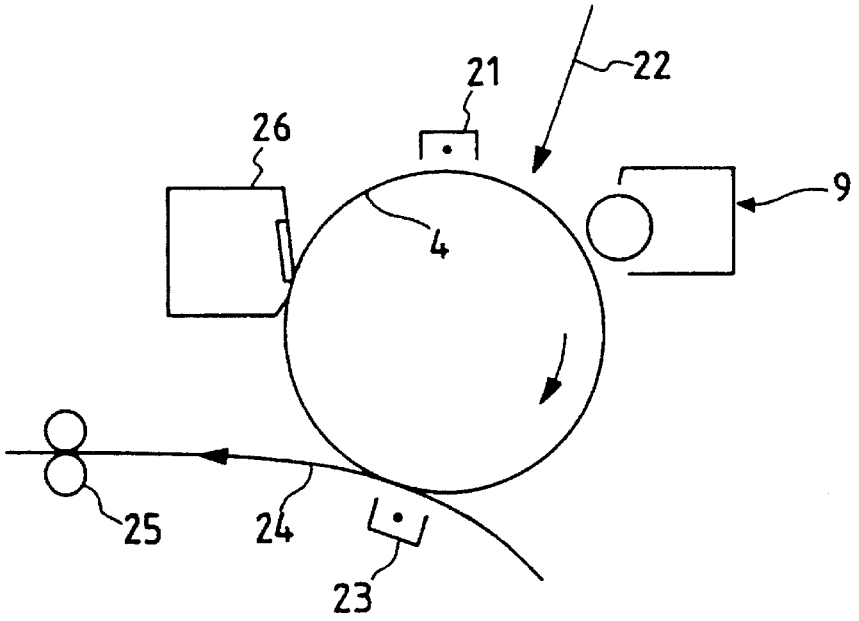
FIG. 14 shows a schematic construction of an image forming apparatus.
Figure 15:
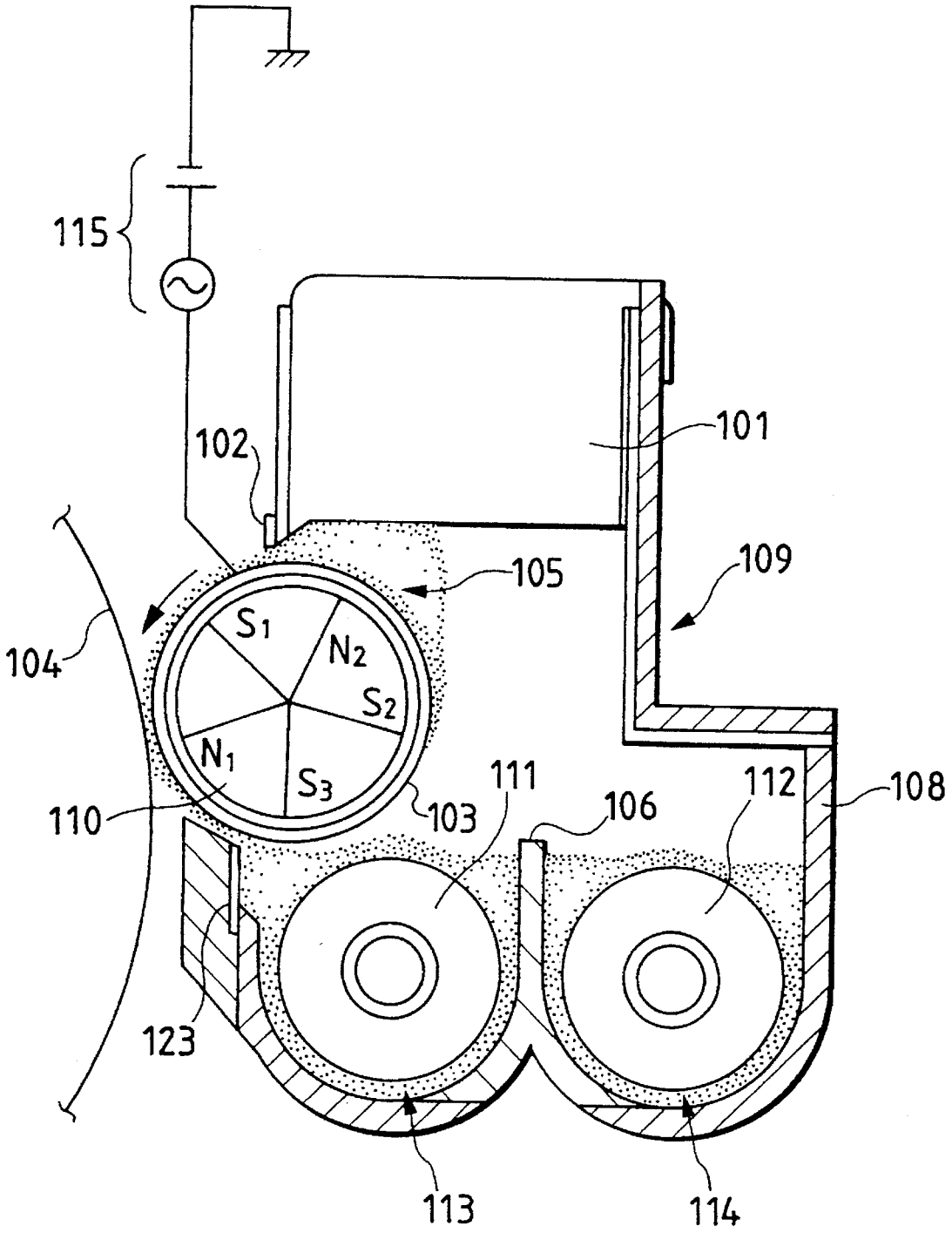
FIGS. 15 and 16 show sectional views of examples of developing devices.

Referring to FIG. 14, in an electrophotographic image forming apparatus, a photoconductive drum 4 which is an image carrier is rotatably arranged and the photoconductive drum 4 is uniformly charged by a primary charger 21 and an information signal is exposed by a light emitting element 22 such as a laser to form an electrostatic latent image, which is visualized by a developing unit 9. The visualized image is then transferred to a transfer sheet 24 by a transfer charger 23 and fixed by a fixing unit 25 to form a permanent image. The remaining toner on the photoconductive drum 4 is removed by a cleaning device 26.

Embodiment 1

Referring to FIGS. 1 to 4, a first embodiment of the developing unit of the image forming apparatus of the present invention is explained.

Figure 1:
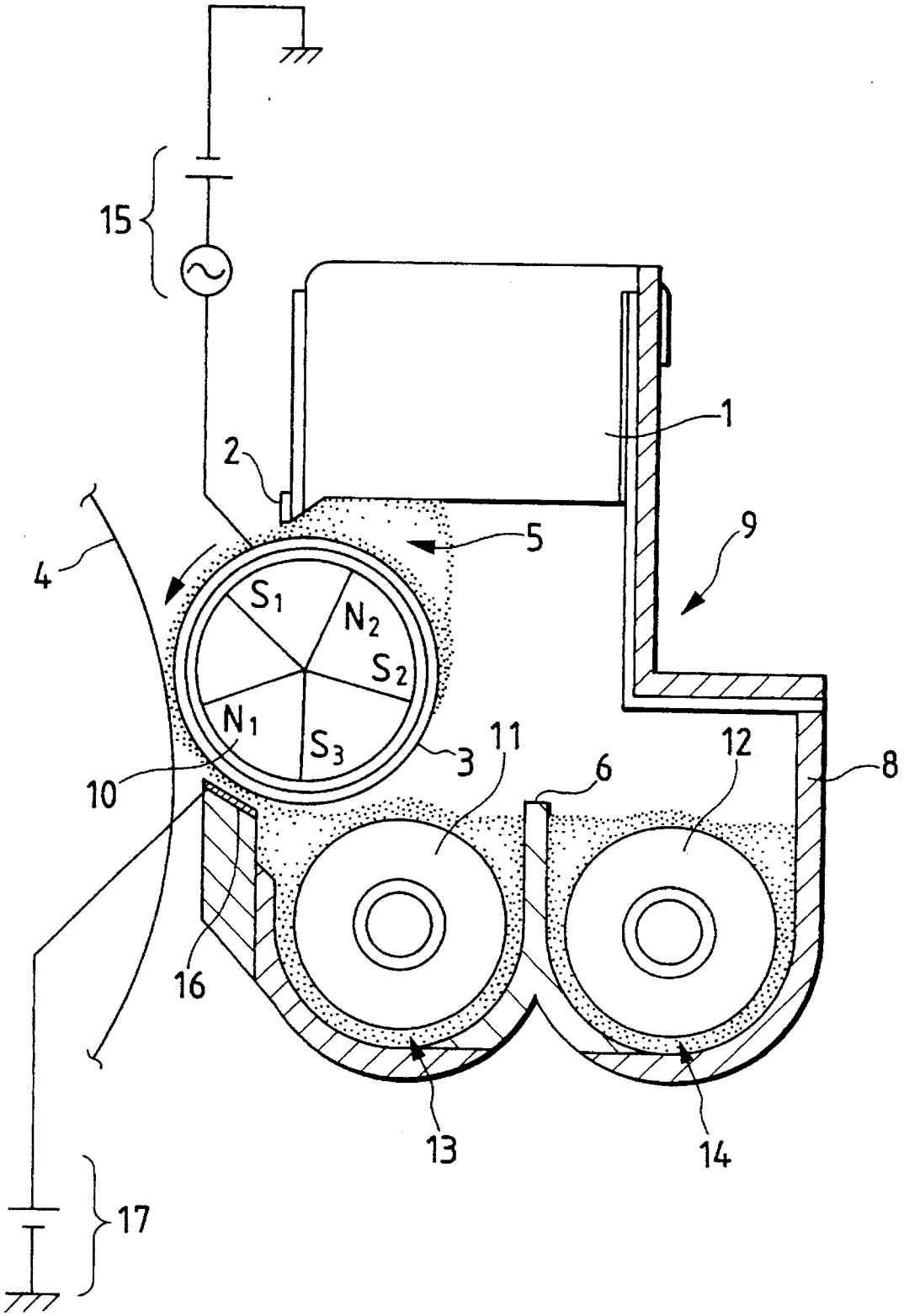
FIG. 1 shows a construction of a first embodiment of an image forming apparatus of the present invention.

As shown in FIG. 1, the developing device 9 comprises a developing container 8, a developing sleeve 3 as developing agent carrying means, a developing agent return member 1 for defining a developing agent gathering part 5, and a blade 2 as a height regulation member for the developing agent. The interior of the developing device 9 is partitioned into a developing chamber 13 and an agitation chamber 14 by a vertically extending wall 6, and the top of the wall 6 is open. Two-component developing agent including non-magnetic toner and magnetic carrier in the present embodiment is accommodated in the developing chamber 13 and the agitation chamber 14, and the extra developing agent in the developing chamber 13 is collected into the agitation chamber 14.

First and second agitation screws 11 and 12 are arranged in the developing chamber 13 and the agitation chamber 14, respectively. The first agitation screw 11 agitates and carries the developing agent in the developing chamber 13, and the second agitation screw 12 agitates and carries the toner supplied from a toner supply bath (not shown) to the upstream of the agitation screw 12 and the developing agent in the agitation chamber 14 under the control of a developing agent concentration control unit and makes the toner density uniform. A developing agent path (not shown) for communicating the developing chamber 13 and the agitation chamber 14 with each other is formed at each of a front end and a rear end of the wall 6 as shown in FIG. 1 so that the developing agent in the developing chamber 13 having the toner density thereof lowered by the consumption of the toner by development is moved from the other path to the agitation chamber 14 by a carrying force of the agitation screws 11 and 12.

The developing chamber 13 of the developing device 9 has an opening at a position corresponding to the developing area facing the photoconductive drum 4, and the developing sleeve 3 is rotatably arranged to be partially exposed to the opening. The developing sleeve 3 is made of a non-magnetic material and it is rotated in a direction of an arrow in FIG. 1 during the developing operation, and a magnet (magnet roller) 10 which is a magnetic field generation means if fixed in the developing sleeve 3. The developing sleeve 3 carries a layer of two-component developing agent having the thickness thereof regulated by the blade 2, and supplies the developing agent to the photoconductive drum 4 in the developing area facing the photoconductive drum 4 to develop the latent image. In order to improve a developing efficiency, that is, deposition rate of the toner to the latent image, a developing bias voltage, for example, having an AC voltage superimposed on a DC voltage is applied to the developing sleeve 3 from a power supply 15.

The developing device 9 holds the developing agent supplied to the surface of the developing sleeve 3 by the agitation screws 11 and 12 in a state of magnetic brush by the magnetic force of the magnet roller 10, carries it to the area (developing area) facing the photoconductive drum 4 by the rotation of the developing sleeve 3, and cuts the magnetic brush by the developing agent return member 1 and the blade 2 to maintain a proper amount of developing agent to be carried to the developing area.

More particularly, the magnet roller 10 of the developing unit is of five-pole construction, and the developing agent agitated by the developing chamber agitation screw 11 is bound by a magnetic force S2 of a carrying magnetic pole (pumping pole) S2 for pumping, and it is carried to the developing agent gathering part 5 by the rotation of the developing sleeve 3. The amount of the developing agent is regulated by the developing agent return member 1 and it is sufficiently bound by a carrying magnetic pole (cut pole) having a predetermined or higher magnetic flux density in order to bind stable developing agent, and it is carried while it forms the magnetic brush. Then, the magnetic brush is cut by the blade or height regulating member 2 to maintain the proper amount of developing agent, which is carried by a carrying magnetic pole S1. The bias voltage having the DC voltage and/or AC voltage superimposed is applied to the developing sleeve 3 through the bias power supply 15 provided in the image forming apparatus in a developing pole N1 and the toner on the developing sleeve 3 is moved to the electrostatic latent image on the photoconductive drum 4 and the electrostatic latent image is visualized as a toner image.

Figure 2:
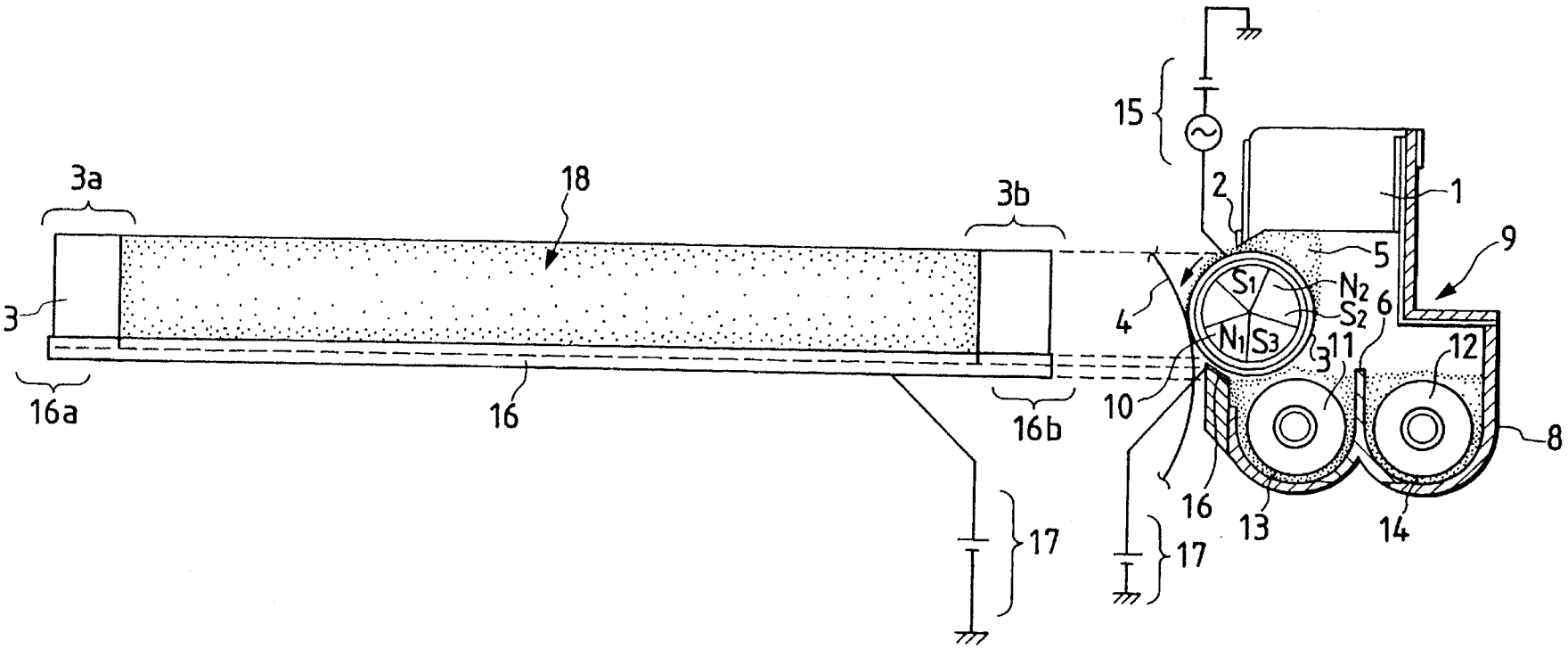
FIG. 2 shows developing agent carrying means and a conductive member of FIG. 1 as viewed from a front of FIG. 1.

Features of the present embodiment are now explained. As shown in FIGS. 1 and 2, a conductive member 16 is arranged in parallel to the developing sleeve 3 in the developing device 9 on the opposite side of the blade 2 relative to the developing sleeve 3. The length of the conductive member 16 is set to be equal to the length of the developing sleeve 3. A power supply 17 is connected to the conductive member 16.

In the present embodiment, the toner has positive charge as a friction charge polarity. A DC voltage of +300 V and an AC voltage of an amplitude of 1000 V are applied to the developing sleeve 3 by the power supply 15 as the developing bias.

The developing agent carried from the carrying magnetic pole S1 to the developing magnetic pole N1 as the developing sleeve 3 is rotated, is used for development while it passes through the area facing the photoconductive drum 4. The developing agent having the toner thereof consumed is taken into the developing chamber 13 by the carrying magnetic pole S3 but the toner of low charge scatters when the developing agent is taken from the developing magnetic pole N1 to the carrying magnetic pole S3.

However, by applying the voltage of +500 V having the same polarity as the polarity of the friction charge of the toner to the conductive member 16 from the power supply 17, an electric field is established between the conductive member 16 and the facing area of the developing sleeve 3 and the vicinity thereof. The polarity of the electric field changes by the alternating voltage of the power supply 15 but it is generally oriented to direct the scattering toner toward the developing sleeve 3. The scattering toner is pushed back to the developing sleeve 3 by the force applied by the electric field and the scattering is suppressed.

Figure 3:
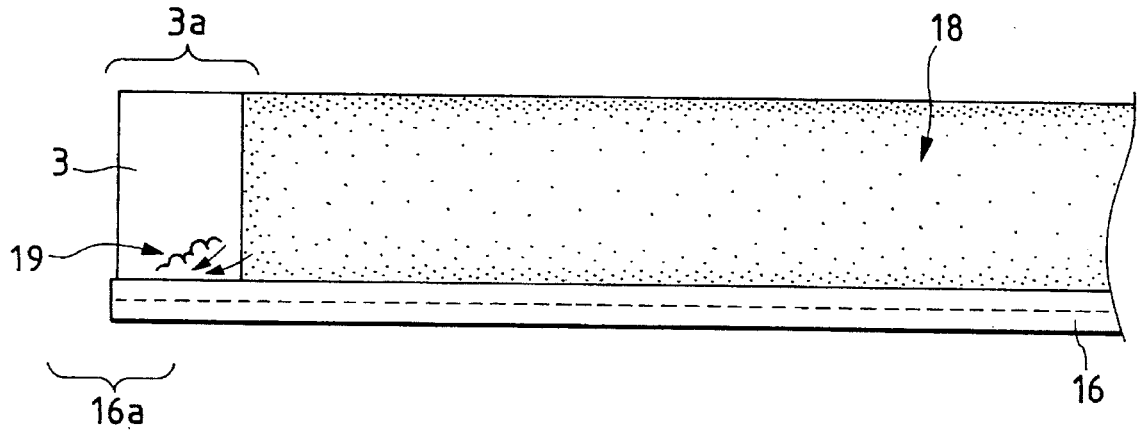
FIG. 3 illustrates the scattering of toner in a left half of the developing agent carrying means and the conductive member.

The scattering toner may possibly fly not only to the developing agent presence area 18 shown in FIG. 2 but also to the opposite ends **3*a* and 3*b* of the developing sleeve 3. FIG. 3 shows the scattering of the toner at the left end of FIG. 2. While only the left end 16*a* is shown in FIG. 3, the same occurs at the right end 16*b*. The scattering toner 19 is pushed back to the developing sleeve 3 by the electric field force created between the conductive member 16 and the developing sleeve 3 as it is in the developing agent presence area 18**, so that it does not scatter outside of the developing unit.

Figure 4:
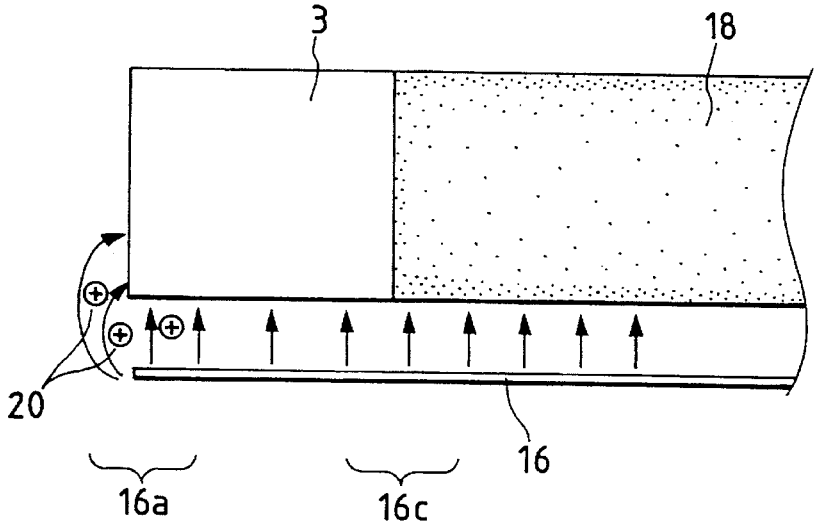
FIG. 4 illustrates an electric field state in the left half of the developing agent carrying means and the conductive member.

As shown in FIG. 4, in the vicinity of the left and right ends **16*a* and 16*b* (only 16*a* is shown in FIG. 4), the electric field is established to encompass the ends and it applies the force to push back to the developing sleeve 3 to the scattering toner 20 which intends to jump out of the left and right ends 16*a* and 16*b*. Thus, the scattering at the opposite ends of the developing sleeve 3** is prevented.

The scattering toners 19 and 20 which are about to leak to the end of the developing sleeve 3 are generated in the area 16C shown in FIG. 4, that is, in the vicinity of the boundary of the developing agent presence area 18 and the developing agent absence area. But, the length of the conductive member 16 is set to be equal to the length of the developing sleeve 3 and the condutive member 16 is arranged to face the developing sleeve 3, whereby an electric field which is substantially perpendicular to the developing sleeve 3 and substantially uniform longitudinally is established in the area 16C, so that the scattering toner is immediately pushed back to the developing sleeve 3 and the amount of the scattering toner 20 which reaches the left and right ends 16*a* and 16*b* is much smaller than the amount of scattering toner in the developing agent presence area 18.

Embodiment 2

Figure 5:
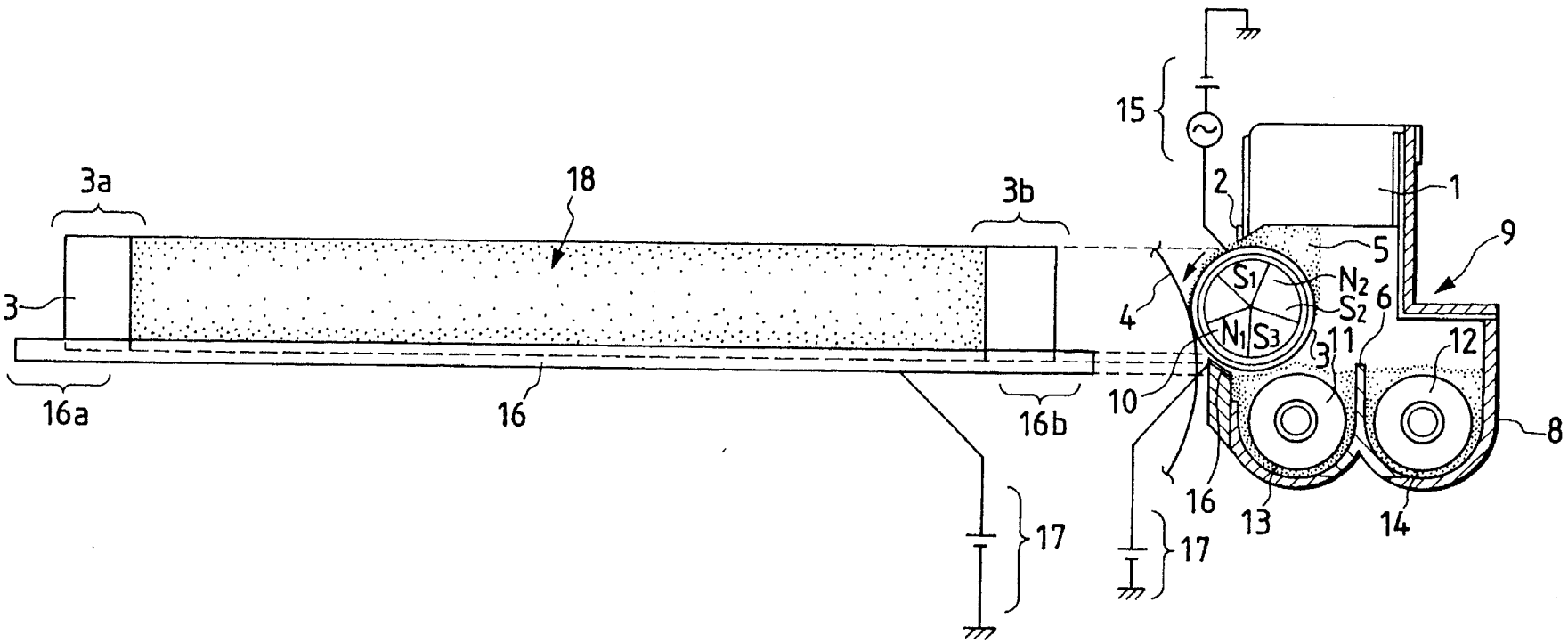
FIG. 5 shows a construction of a second embodiment of the developing device and developing agent carrying means and a conductive member therefor.
Figure 6:
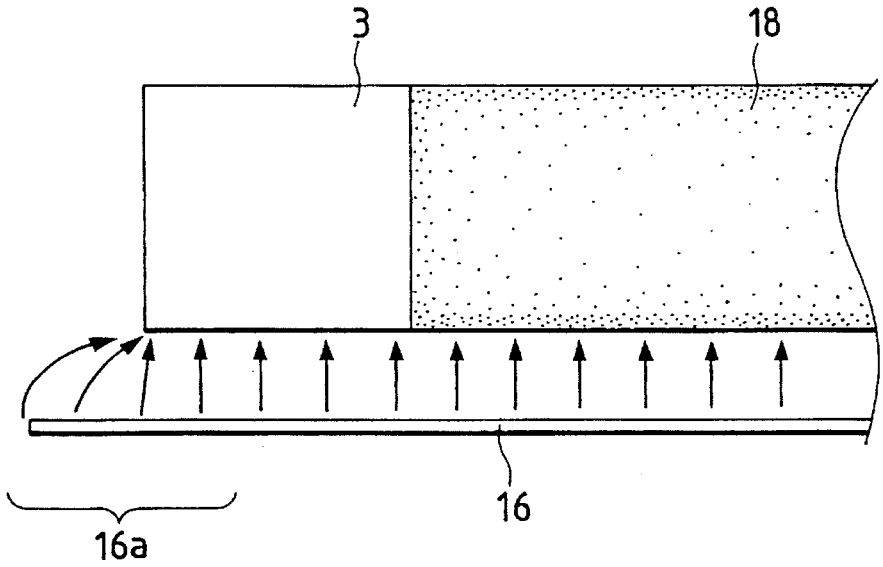
FIG. 6 illustrates an electric field state in a left half of the developing agent carrying means and the conductive member of FIG. 5.

Referring to FIGS. 5 and 6, a second embodiment of the developing device of the present invention is explained. In the developing device of the present embodiment, the length of the conductive member 16 is set to be longer than the length of the developing sleeve 3. Thus, as shown in FIG. 6, the electric field established at the end 16*a* of the conductive member 16 and at the end of the developing sleeve 3 is oriented toward the developing agent presence area 18, and the scattering toner, even if it is scattered to the end, is pushed back to the developing sleeve 3 and the scattering at the end is more effectively suppressed.

Embodiment 3

Figure 8:
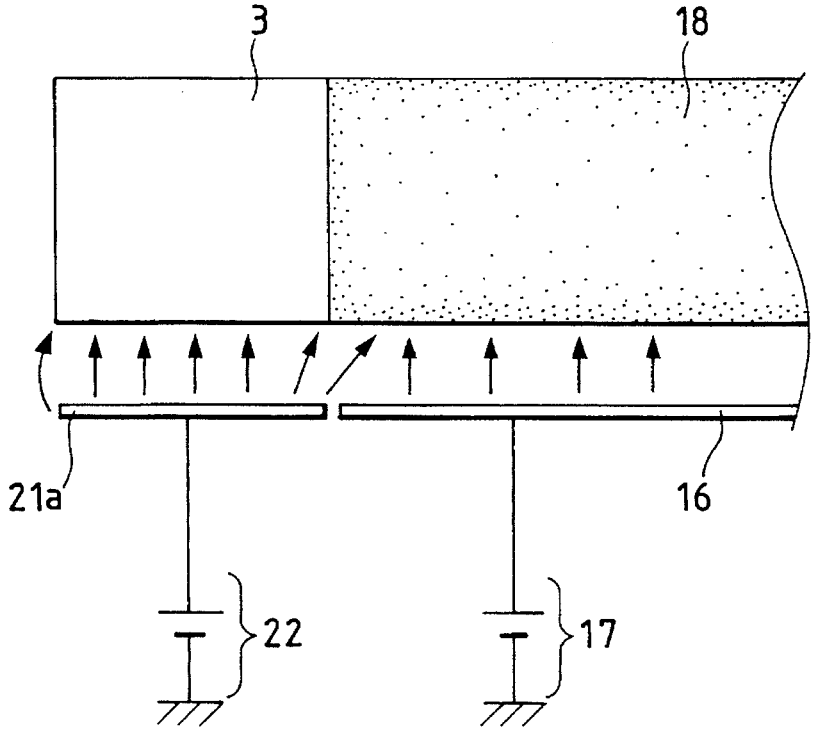
FIG. 8 illustrates an electric field state in a left half of the developing agent carrying means and the conductive member of FIG. 7.
Figure 7:
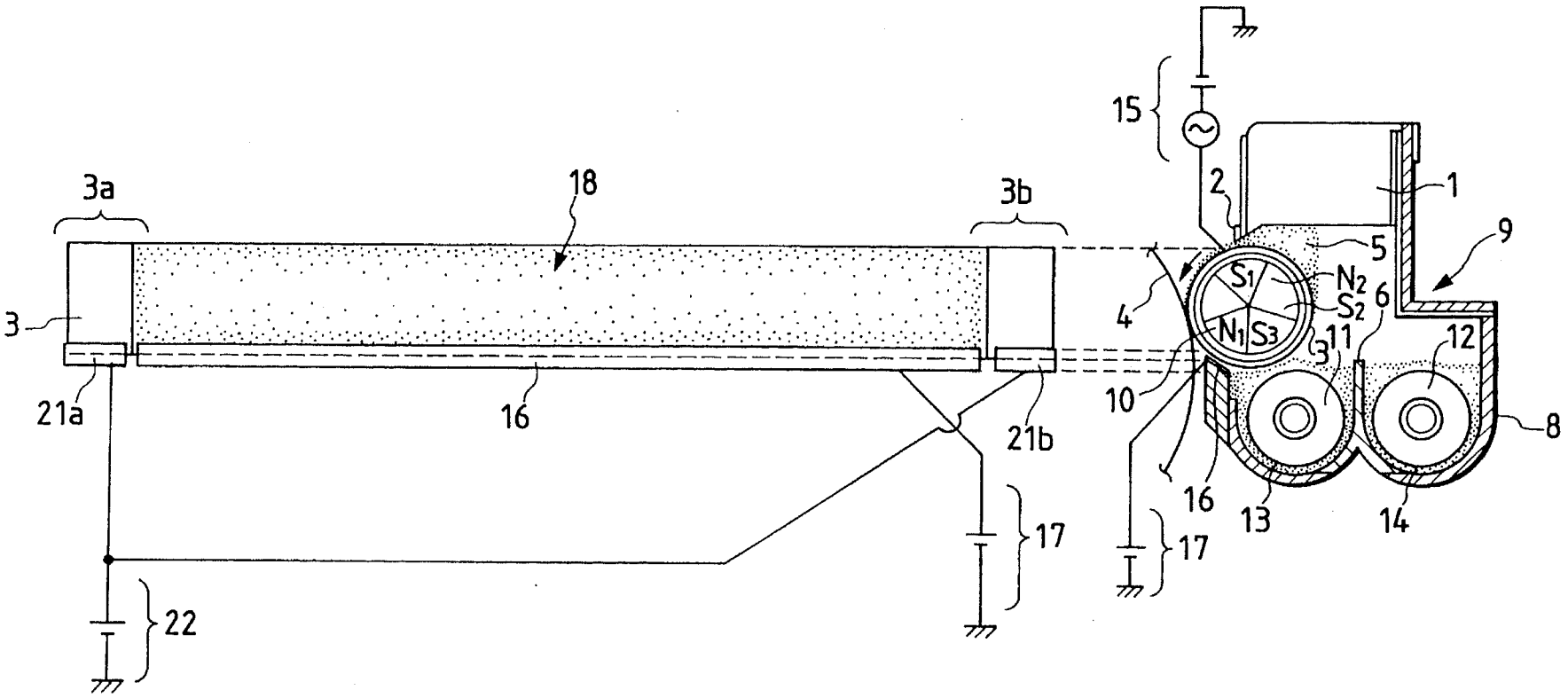
FIG. 7 shows a construction of a third embodiment of the developing device and developing agent carrying means and a conductive member therefor.

Referring to FIG. 7, a third embodiment of the developing device of the present invention is explained. The conductive member in the present embodiment comprises three mutually insulated first to third conductive members 16, 21*a* and 21*b*. The first conductive member 16 faces the entire longitudinal area of the developing sleeve 3 and faces the developing agent presence area 18. The second and third conductive members 21*a* and 21*b* face the opposite ends 3*a* and 3*b*. A DC component of the bias voltage of the developing sleeve 3 is +300 V. A DC voltage of +500 V is applied to the first conductive member 16 from the power supply 17, and a DC voltage of +700 V is applied to the conductive members 21*a* and 21*b* from the power supply 22. At this time, as shown in FIG. 8, an electric field in the vicinity of the opposite ends of the developing sleeve 3 is oriented toward the developing agent presence area 18 from the ends and the scattering toner which intends to jump out of the ends is applied with the force toward the longitudinal center of the developing sleeve 3, that is, the developing agent presence area 18, so that the scattering at the ends is suppressed.

In a modification of the present embodiment, the conductive member is designed to be longer than the developing sleeve at the longitudinally upstream end of the developing agent carrying by the carrying screw and to be the same length as the length of the developing sleeve at the downstream end, and the conductive member is arranged to face the developing sleeve. Since the developing agent is not sufficiently friction-charged and many scattering toners are present at the longitudinally upstream end, the countermeasure is taken for only the upstream end. The same effect as that of the previous embodiment is attained.

In another modification of the present embodiment, the second or third conductive member is arranged at only the longitudinally upstream end in the developing agent carrying direction by the carrying screw. The same effect as that of the previous embodiment is attained.

Embodiment 4

Figure 9:
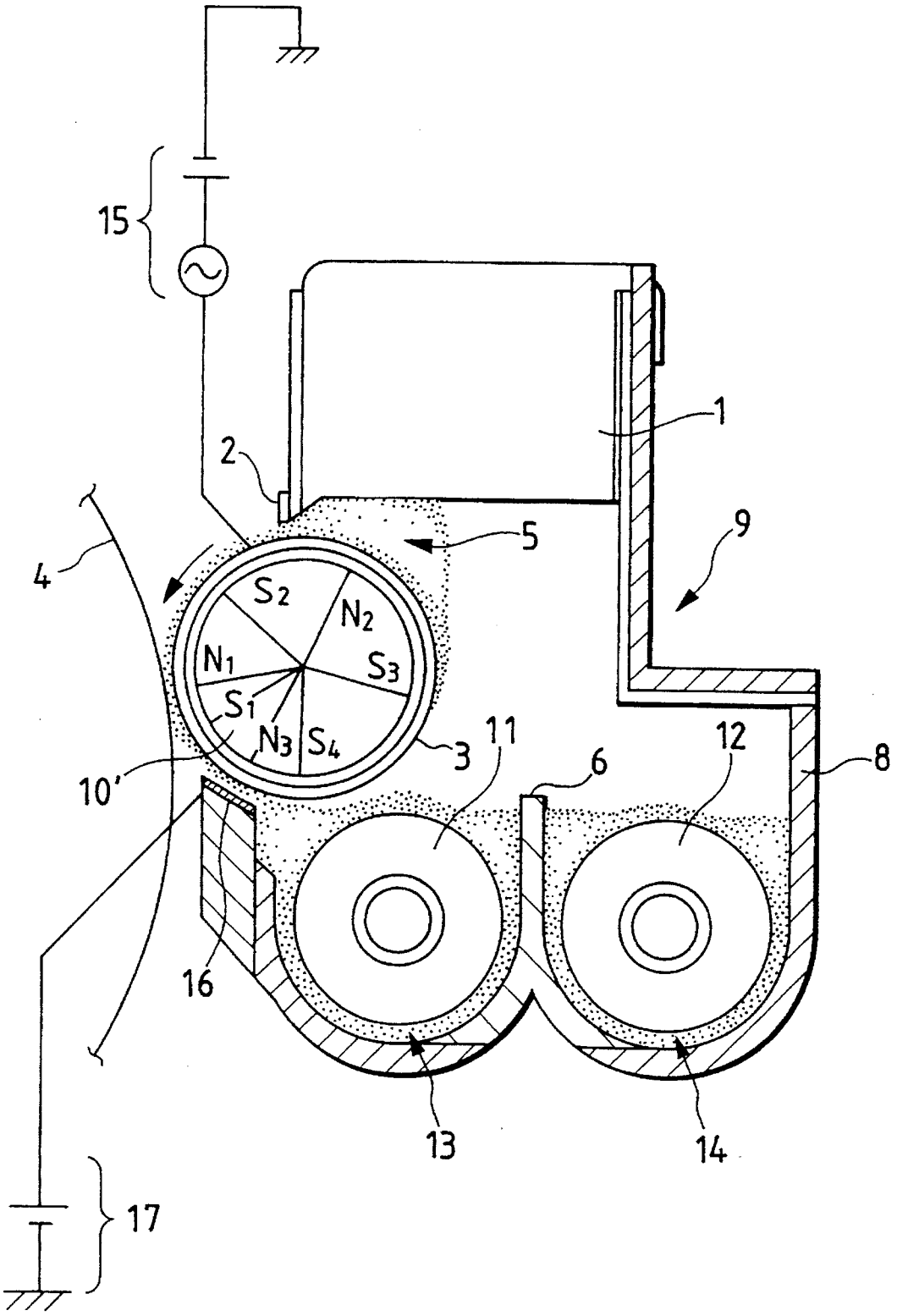
FIG. 9 shows a construction of a fourth embodiment of the developing device of the present invention.

Referring to FIG. 9, a fourth embodiment of the developing device of the present invention is explained. The developing device of the present embodiment is characterized by a seven-pole construction of magnet roller 10', and other construction is identical to that of the developing unit of the first embodiment. In order to improve the image quality, the carrying magnetic poles S1 and N1 are arranged downstream of the developing magnetic pole N1. Even when the developing agent stands due to the carrying magnetic poles S1 and N3 and the scattering occurs, the scattering can be suppressed by the effect of applying the DC voltage to the conductive member 16.

Embodiment 5

Figure 10:
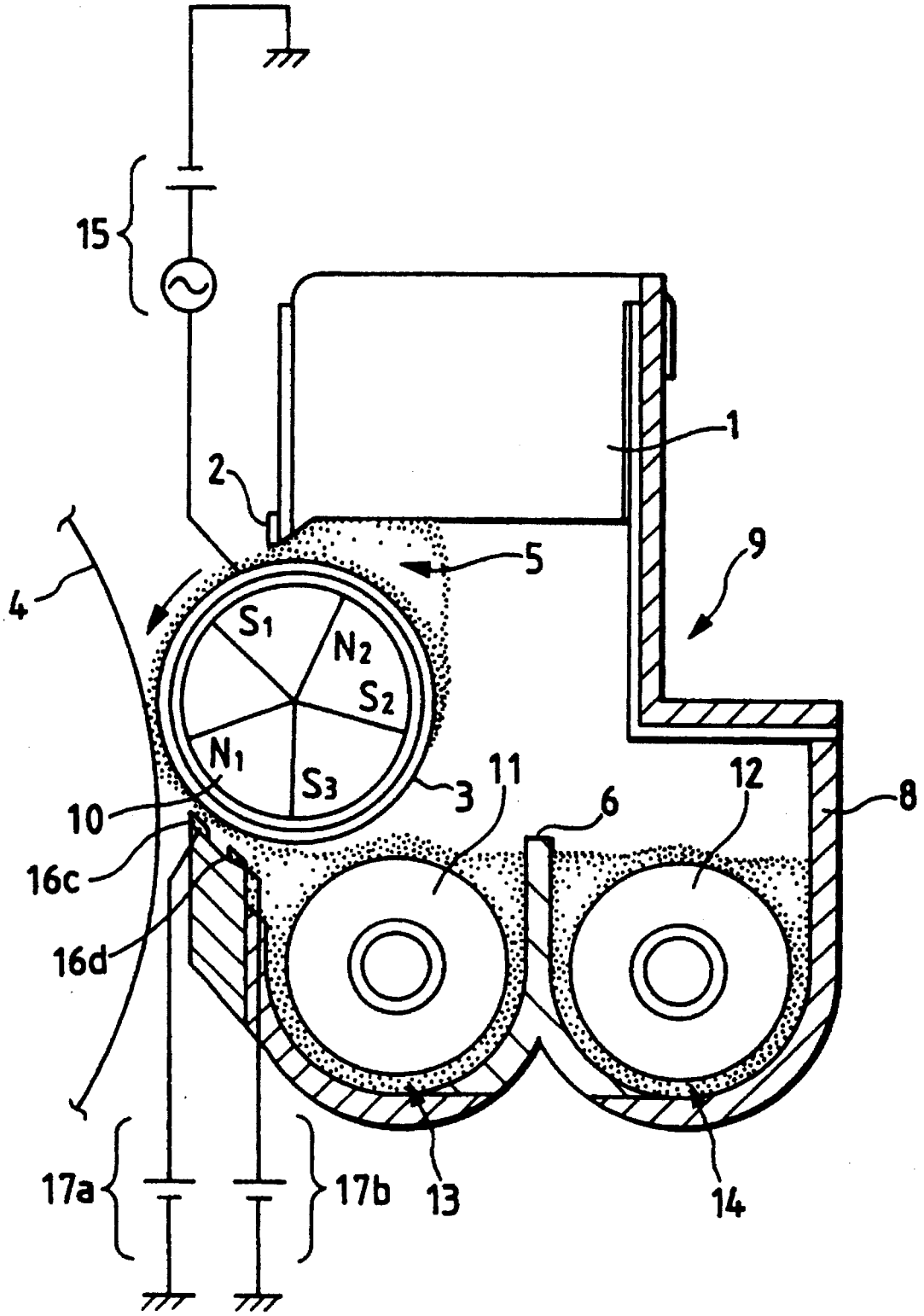
FIG. 10 shows a construction of a fifth embodiment of the developing device.
Figure 11:
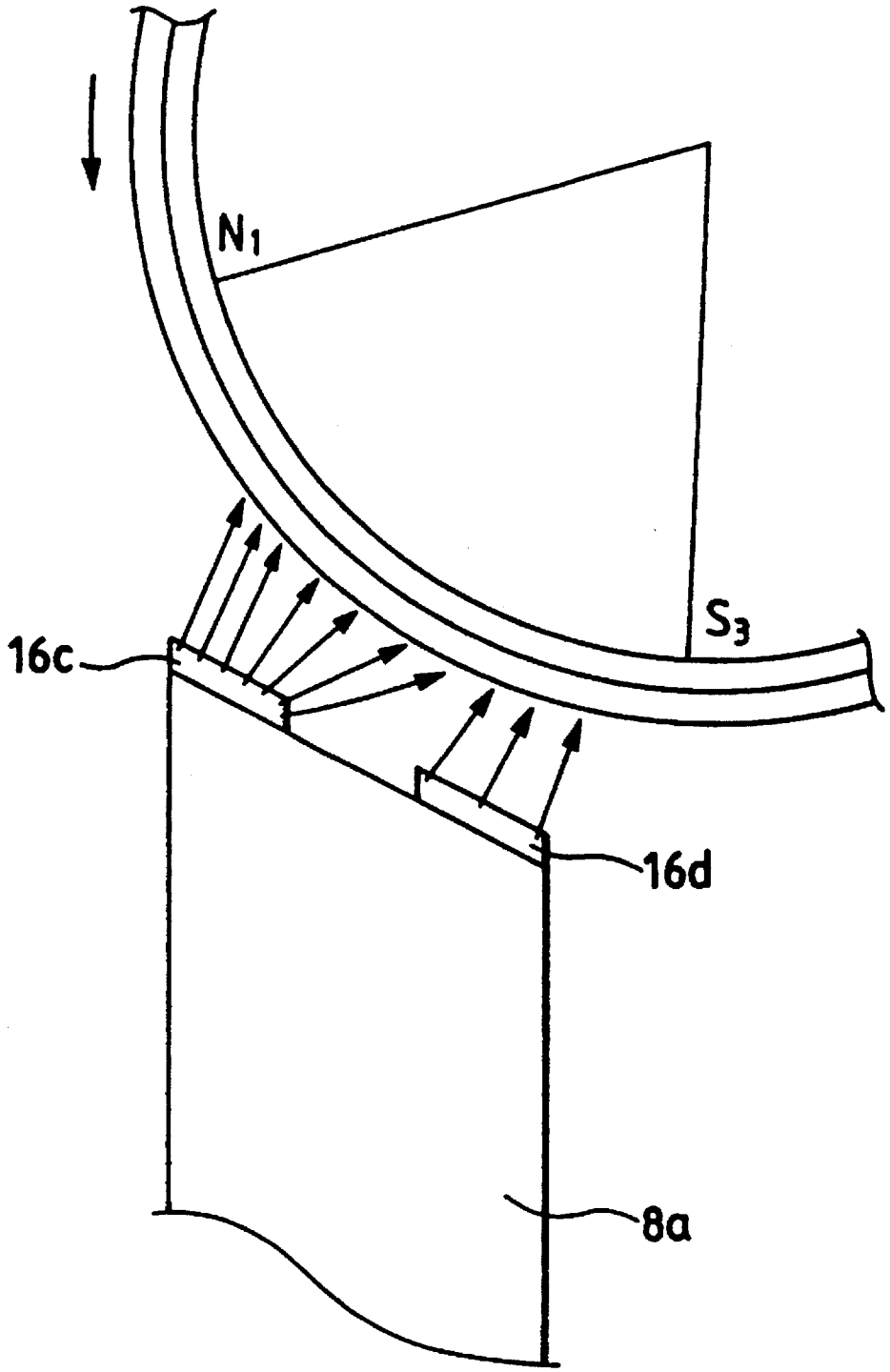
FIG. 11 illustrates an electric field state near a conductive member of the developing device of FIG. 10.

Referring to FIGS. 10 and 11, a fifth embodiment of the developing device of the present invention is explained.

The conductive member in the present embodiment comprises a first conductive member 16*c* and a second conductive member 16*d* of uniform width along a circumference of the developing sleeve 3, and are arranged in the opening 8*a* of the developing container 8 to face the developing sleeve 3 with a predetermined spacing. A DC voltage of +700 V is applied to the first conductive member 16*c* from a power supply 17*a*, and a DC voltage of +500 V is applied to the second conductive member 16*b* from a power supply 17*b*. Thus, while there exists an influence by the alternating voltage of the developing bias around the developing sleeve 3 and the conductive members 16*c* and 16*d*, an electric field which is generally directed downstream of the rotating direction of the developing sleeve 3 is established as shown in FIG. 2.

Around the arrangement of the conductive members 16*c* and 16*d*, scattering toner is present due to the remaining developing agent and the impact when the developing agent is filled into the developing container, and it tends to go out of the developing device 9. However, the scattering toner is pushed against the developing sleeve 3 by the above-mentioned electric field and also receives a force in the rotating direction of the developing sleeve, so that the scattering is efficiently suppressed. For the scattering toner which has reached the area in which the conductive member 16*c* and the developing sleeve 3 face each other and the scattering toner generated in the vicinity thereof, the scattering is sufficiently suppressed because the electric field in the vicinity thereof is lower than that in the downstream area, that is, the area in which the second conductive member 16*d* and the developing sleeve 3 face each other.

In a modification of the present embodiment, three conductive members of the same width are arranged in parallel and DC voltages of +900 V, +700 V and +500 V are applied in the order of closeness to the developing pole N1. As a result, an electric force inclined in the direction of rotation of the developing sleeve 3 is created between the adjacent conductive members but the range thereof is wide enough in the present embodiment and the scattering can be suppressed more efficiently.

Embodiment 6

Figure 12:
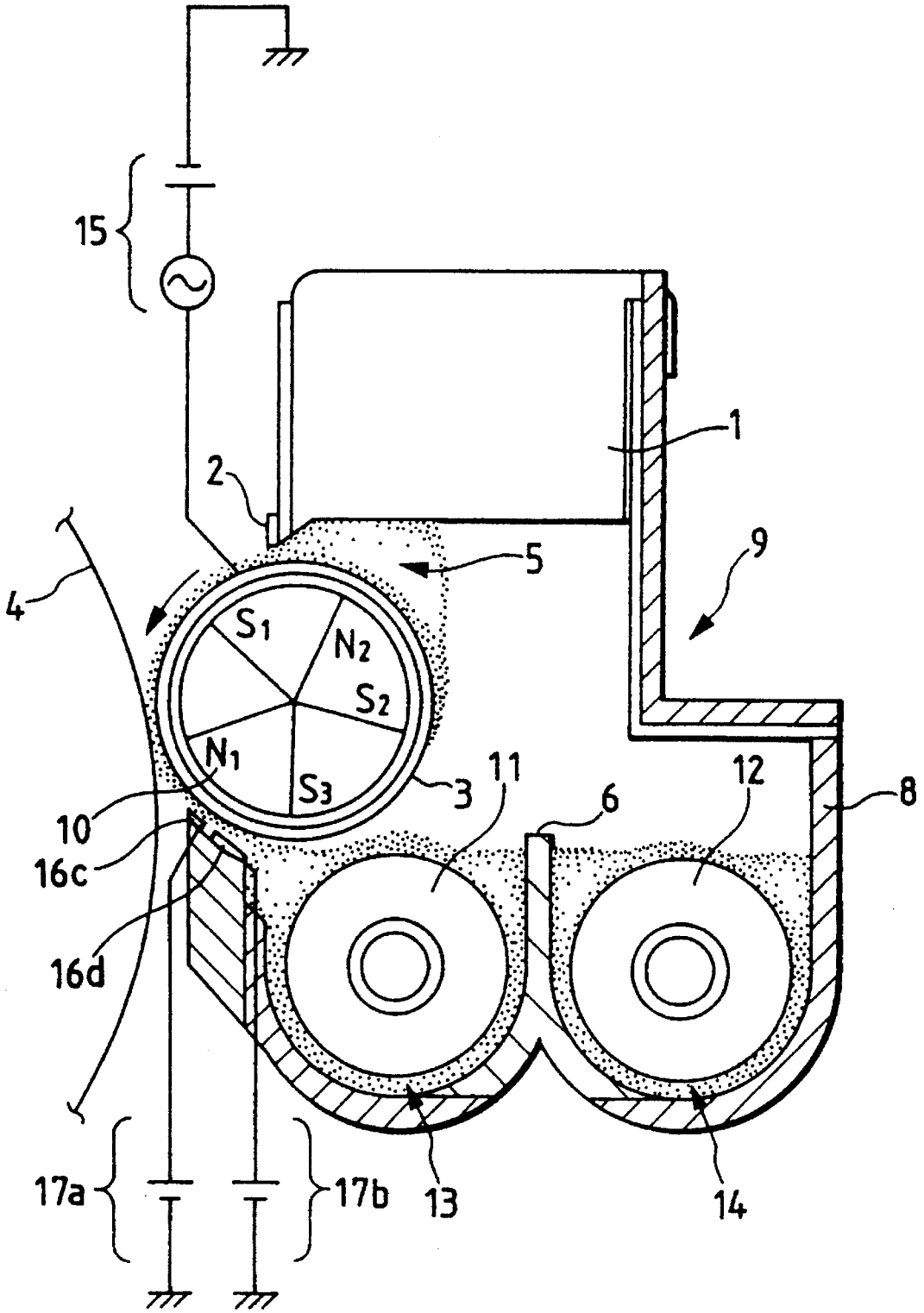
FIG. 12 shows a construction of a sixth embodiment of the developing device.
Figure 13:
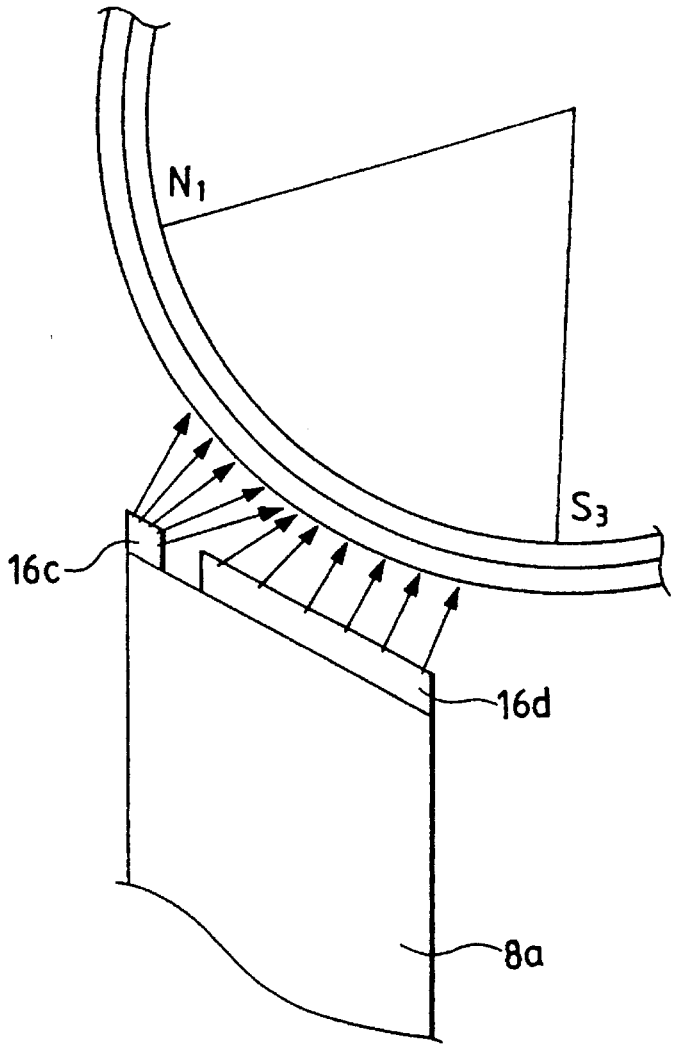
FIG. 13 illustrates an electric field state near a conductive member of the developing device of FIG. 12.

Referring to FIGS. 12 and 13, a sixth embodiment of the developing device of the present invention is explained. FIG. 13 shows an electric field in an area from the developing sleeve 3 to the conductive members 16*c* and 16*d* of FIG. 12.

In the present embodiment, the width of the first conductive member 16*c* (to which the DC voltage of +700 V is applied) is set to be narrower than the width of the second conductive member 16*d* (to which the DC voltage of +500 V is applied).

Thus, as compared with the fifth embodiment, even if the scattering occurs at the upstream side, that is, in the area closer to the developing pole N1 as viewed from the carrying magnetic pole S3, a force can be applied to the scattering toner in the direction of the rotation of the developing sleeve 3, so that the scattering can be effectively suppressed.

Other embodiments of the present invention are now explained.

Figure 16:
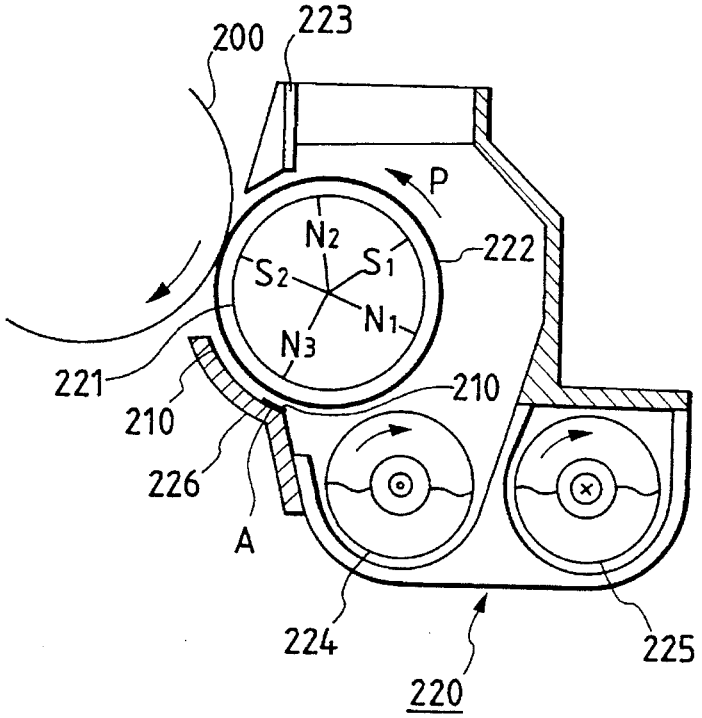

First, a comparative example is shown in FIG. 16.

The developing unit is provided with a developing container 220. A developing sleeve 222 supported rotatable in a direction of an arrow P is arranged in an opening of the developing container 220, and a magnet roller 221 is fixed in the developing sleeve 222. Magnetic poles N1 (pumping pole), S1 (carrying pole), N2 (cutting pole), S2 (developing pole) and N3 (take-in pole) are arranged in sequence in the magnet roller 221 along the rotating direction of the developing sleeve.

As the developing sleeve 222 is rotated in the direction P, the two-component developing agent including the magnetic carrier and the non-magnetic toner, pumped by the action of the pumping pole N1 is carried toward the carrying pole S1 under the action of the magnetic force.

Thereafter, the developing agent is thinly coated on the developing sleeve 222 by the action of the cutting sleeve N2 and a doctor blade 223 which is a layer thickness regulating member. A latent image formed on the photoconductive drum 200 as the image carrier is developed in the vicinity of the area facing the developing pole S2. The developing agent having the toner density decreased by the development is carried to the position facing the take-in pole N3 under the action of the magnetic force, and it is no longer carried due to the action of repulsive force of the take-in pole N3 and the pumping pole N1 and drops in to the developing container 220 by a gravity force which exceeds the carrying force by the take-in pole. The dropped developing agent is circulated in the developing container 220 while it is agitated and carried normally to the plane of the drawing of FIG. 16 by the screws 224 and 225. In the course of the circulation, an appropriate amount of toner is supplemented by a toner concentration detection device (not shown) and the toner supply unit, so that the toner concentration is recovered to a normal concentration.

In the above-mentioned developing device 220, an electrode 210 is arranged in a sleeve cover 226 and a voltage of the same polarity as that to the toner is applied to the electrode 210 with reference to the DC component of the developing bias ($V_{DC}$) applied to the developing sleeve 222, so that the amount of toner scattering out of the developing container 220 through a gap between the outer periphery of the developing sleeve 222 and the inner surface of the sleeve cover 226 can be significantly reduced.

However, when the electrode 210 is arranged at the position A in FIG. 2, that is, in the vicinity of the area facing the take-in pole N3 of the take-in pole N3 as the repulsive pole and the pumping pole N1 which is upstream in the direction of rotation of the developing sleeve, an unevenness occurs in the image. A mechanism of occurrence of such unevenness is considered as follows.

The amount of developing agent carried on the developing sleeve 222 in the area facing the take-in pole N3 is several to tens times larger than the amount of developing agent thinly coated on the developing sleeve 222.

Accordingly, when the electrode 210 is arranged in the area facing the take-in electrode 210, the developing agent fully contacts with the electrode. On the other hand, when the electrode 210 is arranged in the area facing the developing agent coated area, the developing agent does not contact with the electrode.

When the electrode 210 is arranged in the area facing the take-in pole N3, the contact of the developing agent may be prevented by increasing the gap between the electrode 210 and the developing sleeve 222, but the effect to suppress the scattering of the developing agent is also lost.

When the developing agent carried on the developing sleeve 222 completely contacts with the electrode 210, the scattering toner is deposited on the developing agent carried on the developing sleeve 222 and the toner and the carrier in the developing agent carried on the developing sleeve 222 are separated and the toner is deposited on the surface of the developing sleeve 222, so that a two-layer structure in which a carrier rich layer is formed on the toner layer is formed (although it is not completely separated).

The upper carrier rich layer, thereafter, drops into the developing container 220 by the action of the repulsive poles N3 and N1 but the lower toner layer passes through the repulsive electrodes N3 and N1. Thus, an unevenness occurs in the potential on the surface of the developing sleeve 222 depending on the unevenness of the thickness of the passed toner layer and an unevenness also occurs in the toner concentration of the developing agent coated on the developing sleeve 222 (because the toner concentration regulated developing agent is coated on the toner layer) which causes an unevenness in the image.

An embodiment which prevents the unevenness in the image when the expelling pole is used is now explained.

Embodiment 7

Figure 17:
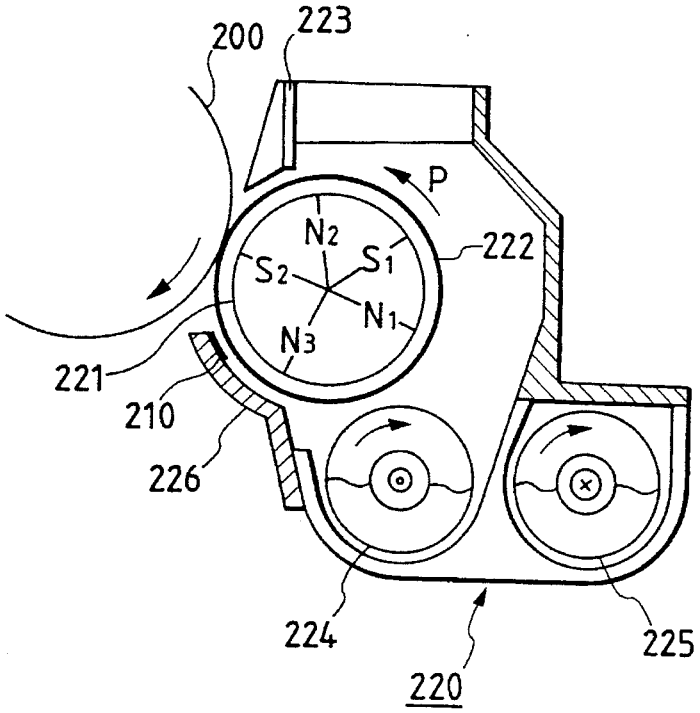
FIGS. 17 to 19 show sectional views of different embodiments of the present invention, respectively.

Referring to FIG. 17, numeral 210 denotes an electrode which is arranged at a position spaced by 2 mm from the surface of the developing sleeve 222.

The developing agent used in the present embodiment is two-component developing agent including magnetic carrier and non-magnetic toner and the toner is charged negatively. The amount of coating of the developing agent thinly coated on the developing sleeve 222 is approximately 50 mg/cm$^2$.

In the present embodiment, a voltage of −1000 V (relative to ground) is applied to the electrode 210 from a high voltage power supply (not shown).

In an image forming apparatus which uses the developing device of the present embodiment, $V_{DC}$ of the developing bias applied to the developing sleeve 222 is controlled between −850 V to −350 V, so that a voltage of −850 V to −350 V relative to $V_{DC}$ is applied to the electrode 210.

By arranging the electrode 210 upstream of the vicinity of the upstream take-in pole N3 of the repulsive poles, the contact of the developing agent with the electrode 210 is prevented and the unevenness in the image is prevented and the amount of scattering toner is suppressed to approximately ⅕ to 1/10 of that when the electrode 210 is not provided.

In the present embodiment, since the electrode 210 is arranged closely to the area in which the end of the magnetic agent (magnetic brush) lies between the developing pole S2 and the take-in pole N3, the electrode 210 can be arranged more closely to the developing sleeve 222 than when the electrode 210 is arranged in the position facing the magnetic pole.

Embodiment 8

Figure 18:
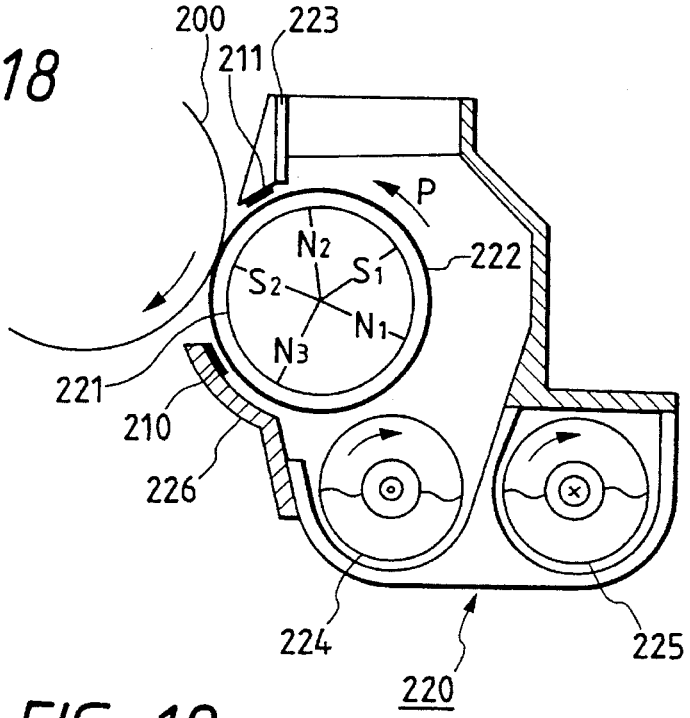

FIG. 18 shows a sectional view of a construction of the developing device of the present embodiment.

In the present embodiment, another electrode 211 is arranged (with a spacing of 2 mm from the surface of the developing sleeve) in addition to the electrode 210. The voltage applied to the electrodes 210 and 211 and the power supply therefor are identical to those of the Embodiment 7.

By this arrangement, a greater effect to suppress the scattering toner is attained and the effect of the suppressing the scattering toner is approximately 1.5 times as high as that of the Embodiment 7.

Embodiment 9

A sectional view of the construction of the developing device of the present invention is identical to that of the Embodiment 8, but the power supply of the voltage applied to the electrodes 210 and 211 is different.

In the Embodiments 7 and 8, the voltages applied to the electrode 210 or the electrodes 210 and 211 are supplied from the high voltage power supply (not shown). In the present embodiment, a circuit (not shown) for cutting a positive component relative to $V_{DC}$ of the AC component of the developing bias applied to the developing sleeve 222 is provided, and the developing sleeve 222 and the electrodes 210 and 211 are coupled through the circuit to supply the voltage to be applied from the developing bias voltage to the electrodes 210 and 211.

By this arrangement, the same effect as that of the Embodiment 8 is attained by a simpler construction.

The voltages applied to the electrodes 210 and 211 are substantially the same as those applied in the Embodiment 8.

In the Embodiments 7 to 9, the two-component developing agent is used although the present invention is effective to the developing agent using one-component magnetic toner because the present invention effectively prevents the problem of the unevenness in the image by the fusing of the toner on the developing sleeve when the electrode is arranged in the vicinity of the take-in electrode N3.

Embodiment 10

Figure 19:
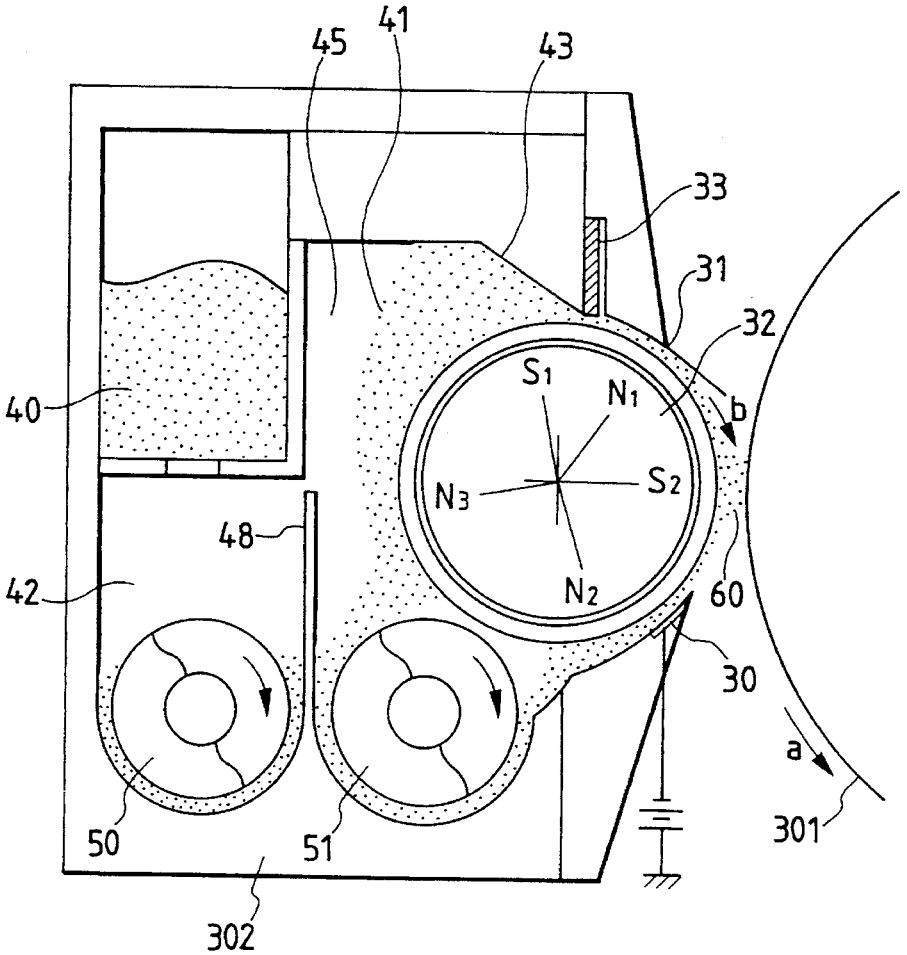

FIG. 19 shows a sectional view of another embodiment of the developing unit of the present invention.

In FIG. 19, an opening is formed at a position close to an image carrier 301 of the developing container 302, and a developing sleeve 31 is rotatably arranged in the opening to face the image carrier 301, and a blade 33 is arranged at a position close to the top of the developing sleeve 31 with a predetermined spacing therefrom. In the present embodiment, an electrode plate 30 is arranged below the developing sleeve 31 with a predetermined spacing therefrom. The electrode plate 30 will be described in detail later.

The developing sleeve 31 is made of a nonmagnetic material and it is rotated in a direction b during the development operation. A magnet roller 32 which is a magnetic field generation means is stationarily arranged in the developing sleeve 31, and the developing pole S2, the carrying pole S1 for carrying the developing agent 41 and other poles N1, N2 and N3 are provided by magnetization in the magnet roller 32. The polarities of the magnetic poles S1 to N3 may be of opposite combination.

The blade 33 is made of a non-magnetic material such as aluminum or non-magnetic stainless steel (SUS) and arranged with the predetermined spacing from the surface of the developing sleeve 31 as described above. By this spacing, the amount of developing agent 41 carried on the developing sleeve 31 and carried to the developing station 60 facing the latent image more specifically the thickness of the developing agent 41 on the developing sleeve 31 is regulated. Accordingly, in the present embodiment, the non-magnetic toner 40 and the magnetic carrier 43 of the developing agent 41 pass through the area between the end of the blade 33 and the surface of the developing sleeve 31 and they are carried to the developing station 60.

The developing agent 41 is two-component developing agent including the toner 40 and the magnetic carrier 43, and the toner 40 is a toner for color copying machine primarily including polyester resin or styrene acryl acid ester resin having an average volume grain size of less than 12 μm, preferably less than 10 μm. In the present embodiment, it is 8 μm.

The magnetic carrier 43 may be ferrite particles (maximum magnetization of 60 emu/g) having average weight grain size of 30 to 80 μm, preferably 40 to 70 μm and a resistivity of more than $10^7$ Ωcm, preferably more than $10^8$ Ωcm. In the present embodiment, the average weight grain size is 50 μm.

The toner 40 and the magnetic carrier 43 are agitated in the direction of the arrow in the agitation chamber 42 by the first developing agent agitation/carrying means 50, and carried to the developing chamber 45 through the wall 48.

The developing agent 41 is held on the developing sleeve 31 by the action of the magnet roller 32 so that it is carried to the developing station 60, and the toner 40 in the developing agent 41 is provided for the development in the developing station 60, thereafter, it is carried to the magnetic pole N2 at the bottom of the developing sleeve 31 downstream of the developing station 60. Since the magnetic pole N2 of the magnet roller 32 is of the same polarity as that of the downstream magnetic pole N3, a repulsive magnetic force is created therebetween. Thus, the developing agent 41 carried to the magnetic pole N2 while it is held by the developing sleeve 31 is removed off the developing sleeve 31 by the action of the repulsive magnetic field, agitated and mixed by the second developing agent agitation/carrying means 51 (rotated in the direction of the arrow) in the developing chamber 45, while new developing agent 41 is supplied to the developing sleeve 31 in the vicinity of the magnetic pole N3.

The direction of rotation of the second developing agent agitation/carrying member 51 is such that the carrying of the developing agent 41 along the line of magnetic force of the repulsive magnetic field formed by the magnetic poles N2 and N3 of the magnet roller 32 is facilitated.

The developing agent 41 which has been subjected to the development on the developing sleeve 31 is removed off the developing sleeve 31 and sufficiently agitated in the carrying path of the second developing agent agitation/carrying means 51, and the new developing agent is continuously supplied onto the developing sleeve, so that a stable and high quality image is produced.

Figure 20:
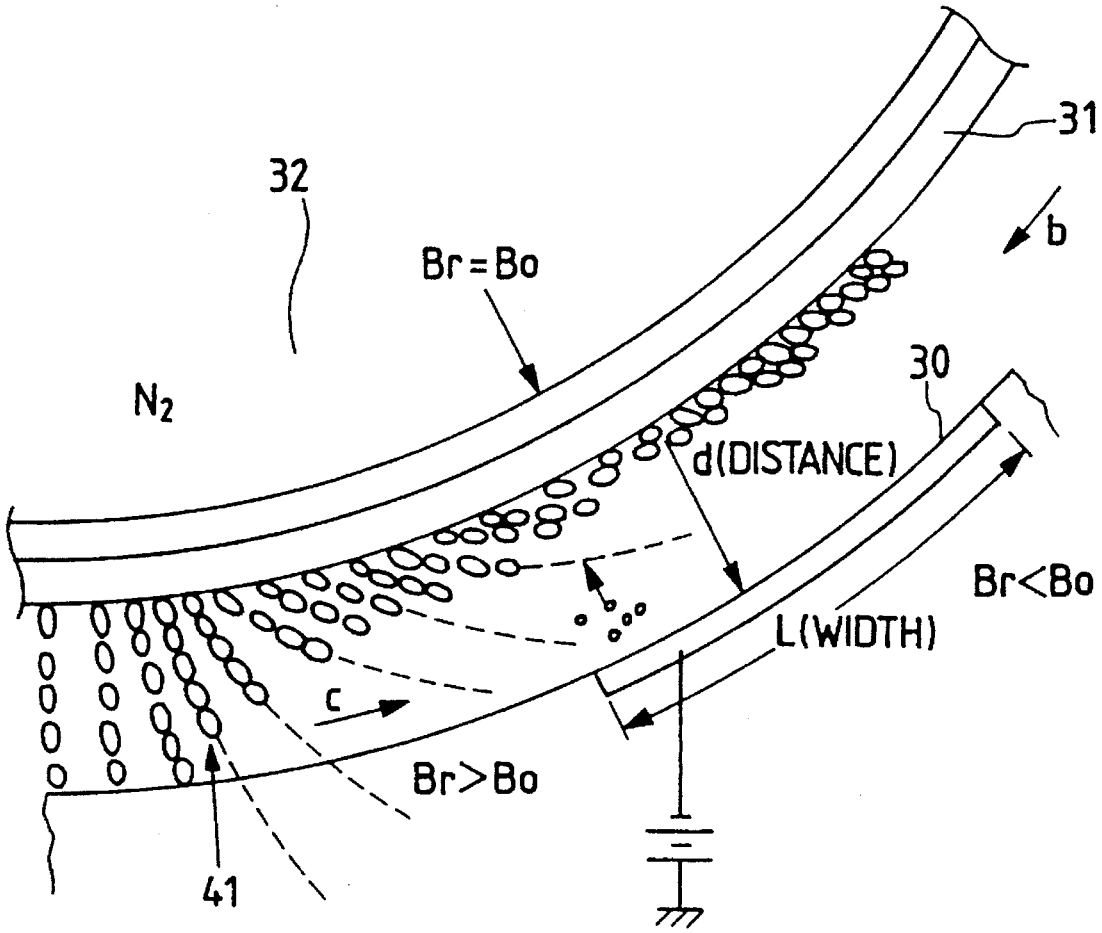
FIG. 20 shows a partial enlarged view of the device of FIG. 19.

The electrode plate 30 of the present embodiment is arranged in the vicinity of the developing sleeve 31 upstream of the magnetic pole N2 below the developing sleeve 31 as viewed in the direction of rotation of the developing sleeve 31. Referring to FIG. 20, the effect of the electrode plate 30 is explained.

As the developing sleeve 31 is rotated, the developing agent 41 is carried to the vicinity of the magnetic pole N2 after the development. In the vicinity of the magnetic pole N2, the developing agent 41 severely stands along the line of magnetic force because it forms repulsive pole to the magnetic pole N3. As a result, in the vicinity of N2, the developing agent 41 collide to each other or collides to a portion of the developing container 302 facing N2, and the magnetic carrier 43 and the toner 40 are separated by the shock thereof.

The separated toner 40 is carried in the direction c and scattered out of the developing container 302 and contaminates the device.

In the present embodiment, in order to prevent the scattered toner 40 from scattering out, a bias voltage of the same polarity as that of the toner 40 is applied to the electrode plate 30, so that the toner 40 is deposited on the developing agent 41 and collected into the device. The electrode plate 30 is faced to the developing sleeve 31 and the voltage of the same polarity as that of the toner 40 relative to the DC component of the developing sleeve 31 is applied, but there exists a critical relation between the position and the width of the electrode plate 30, which is now explained.

As to the position of the electrode plate 30, it may be at any position before the developing agent 41 is collected into the developing container 302 down stream of the developing station which is the developing area on the developing sleeve 31.

In the vicinity of the magnetic pole on the developing sleeve 31, the developing agent 41 stands and falls, so that the developing agent 41 violately moves. Further, because the developing agent 41 stands, the developing agent is ununiformly distributed on the developing sleeve 31.

When the bias toward the developing sleeve 31 is applied to the electrode plate 30 under such a condition, the toner 40 is not sufficiently deposited to and collected by the magnetic carrier 43 and the separated and scattered toner moves out of the device.

Accordingly, it is necessary that the electrode faces the area in which the developing agent between the magnetic electrodes lie down. In such an area, the developing agent 41 does not chain as shown in FIG. 20 but lies down uniformly over the developing sleeve 31 and does not violately move due to the standing. Thus, the toner 40 moved toward the developing sleeve 31 by the electric field of the electrode plate 30 is positively collected by the magnetic carrier 43 and the scattering is substantially prevented.

Since this condition can be fully met in the vicinity of the area in which a horizontal magnetic flux density Bθ is larger than a magnetic flux density Br normal to the surface of the developing sleeve 31, it is sufficient that a portion of the electrode plate 30 faces the area where Be>Br.

There is also a critical relation between the distance d between the electrode plate 30 and the developing sleeve 31 and the width L of the electrode plate 30 along the direction of rotation of the developing sleeve 31. When the width L of the electrode plate 30 is reduced and the minimum distance d is reduced, the scattering toner 40 is not reduced whatever high electric field is applied to the electrode plate 30. This maybe explained as follows. Since the tribo (charges of the toner) of the scattering toner 40 is low, the tracking property to the electric field is lower than that of the toner 40 which contributes to the developing. Thus, even if the force toward the developing sleeve 31 is applied by the electrode plate 30, the toner does not immediately follow.

When the width L of the electrode plate 30 is longer than the minimum distance d of the electrode plate 30 to the developing sleeve 31, the toner 40 having the low electric field tracking ability also can reach the position of the developing agent 41 on the developing sleeve 31, so that the scattering may be prevented. In a number of experiments, it has been proved that the scattering of the toner 40 can be positively reduced by selecting the width L of the electrode plate 30 longer than the distance d in FIG. 20.

A more detailed condition of the present embodiment is now explained.

An image is formed under the following developing condition.

In a reversal developing method, the developing agent 41 is negatively charged toner, the developing bias voltage is DC −400 V, the amount of developing agent coating is 50 mg/cm$^2$, the distance d between the electrode plate 30 and the developing sleeve 31 is 2 mm, the bias voltage applied to the electrode plate 30 is −900 V, and the width L of the electrode plate 30 is 5 mm.

The images were formed up to 10,000 sheets under the above-mentioned condition and no scattering of the toner 40 occurred.

Embodiment 11

The same condition as that of Embodiment 10 was used except the developing bias was changed to a DC voltage having an AC voltage superimposed with the DC being −400 V and AC being 2 KV p-p at 2 KHz. The scattering was sufficiently prevented by the bias of the electrode plate 30. Thus, even if the AC oscillating electric field is generated, the developing agent 41 can be sufficiently collected if the electric field acting in the direction to the developing sleeve 31 is present.

It has been proved that the same effect is attained by providing a protective layer of an electrical insulating resin such as Mylar (tm) or Teflon (tm) on the surface of the electrode plate 30.

Embodiment 12

Figure 21:
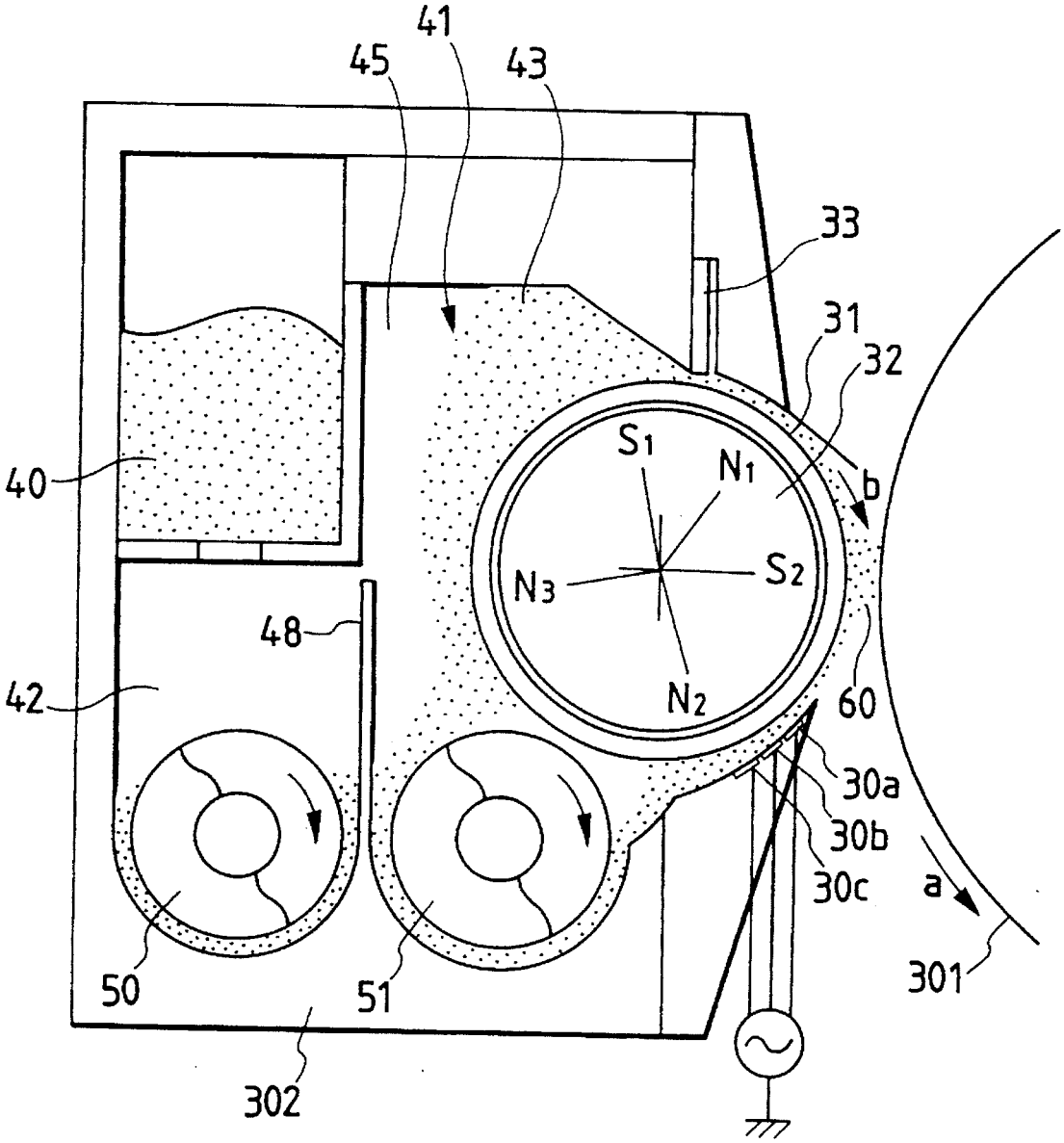
FIG. 21 shows a sectional view of another embodiment of the developing device of the present invention.

The construction is identical to that of Embodiment 10 except the electrode plate. As the electrode plate 30, three electrode plates 30*a*, 30*b* and 30*c* of 2 μm width are arranged in sequence along the direction of carry as shown in FIG. 21, and a three-phase AC directed to the unit is superimposed on the DC bias voltage of −800 V. This arrangement can also reduce the scattering of the toner 40.

While the preferred embodiments of the present invention have been described, the present invention is not limited to those embodiments but they may be changed or modified without departing from the scope of the invention.

What is claimed is:

1. A developing device comprising:

a developing container for accommodating developing agent including toner;

a developing agent carrier arranged at an opening of said developing container so as to face an image carrier carrying an electrostatic image and for rotating while carrying the developing agent in said developing container;

a plurality of conductive members arranged along a longitudinal direction of said developing agent carrier with a spacing from said developing agent carrier in a developing agent collecting portion of said developing container, said plurality of conductive members being provided along a rotation direction of said developing agent carrier; and voltage application means for applying a voltage having the same polarity as a charging polarity of the toner to said plurality of conductive members.

2. A device according to claim 1, wherein said toner is non-magnetic.

3. A device according to claim 2, wherein said developing agent has magnetic carrier, and said developing agent carrier has a magnet therein.

4. A device according to claim 1, wherein said conductive members are provided in a toner collecting portion of said developing container.

5. A device according to claim 1, wherein said plurality of conductive members are provided over longer than the longitudinal area of said developing agent carrier.

6. A device according to claim 1, wherein a conductive member provided upstream of said developing agent carrier in a direction of movement is longer than a downstream conductive member.

7. A device according to claim 1, wherein the voltage applied to a conductive member closer to the developing area by said developing agent carrier is larger in absolute value than that applied to a farther conductive member.

8. A developing device comprising:

a developing container for accommodating developing agent including toner;

a developing agent carrier arranged to face an image carrier carrying an electrostatic image and for rotating while carrying the developing agent;

magnetic field generation means arranged in said developing agent carrier for carrying the developing agent by a magnetic force, said magnetic field generation means including a first magnetic pole and a second magnetic pole having the same polarity as that of the first magnetic pole and adjacent to the first magnetic pole in the downstream direction in a direction of movement of said developing agent carrier;

a layer thickness regulation member arranged downstream of said second magnetic pole in the direction of movement of said developing agent carrier for regulating the thickness of the developing agent layer on said developing agent carrier;

a conductive member arranged downstream of said layer thickness regulation member and upstream of said first magnetic pole in the direction of movement of said developing agent carrier and having a spacing from said developing agent carrier and arranged along the longitudinal direction of said developing agent carrier; and voltage application means for applying a voltage of the same polarity as the charging polarity of the toner to said conductive member.

9. A device according to claim 8, wherein said toner is non-magnetic.

10. A device according to claim 9, wherein said developing agent includes non-magnetic toner and magnetic carrier.

11. A device according to claim 8, wherein said magnetic field generation means includes a third magnetic pole in said developing agent carrier, and said conductive member is arranged downstream of said third magnetic pole in the direction of movement of said developing agent carrier.

12. A developing device comprising:

a developing container for accommodating developing agent including toner;

a developing agent carrier arranged to face an image carrier carrying an electrostatic image and for rotating while carrying the developing agent;

magnetic field generation means arranged in said developing agent carrier for carrying the developing agent by a magnetic force; and a conductive member arranged along the longitudinal direction of said developing agent carrier with a spacing from said developing agent carrier;

said conductive member being arranged such that at least a portion thereof faces an area in which a magnetic flux density normal to the surface of said developing agent carrier is smaller than a horizontal magnetic flux density.

13. A device according to claim 12, wherein said toner is non-magnetic.

14. A device according to claim 13, wherein said developing agent includes non-magnetic toner and magnetic carrier.

15. A device according to claim 12, wherein the width of said conductive member in a direction of movement of said developing agent carrier is larger than a distance between said conductive member and said developing agent carrier.

* * * * *

UNITED STATES PATENT AND TRADEMARK OFFICE

CERTIFICATE OF CORRECTION

PATENT NO. : 5,581,336

DATED : December 3, 1996

INVENTOR(S) : SHIGERU MATSUZAKI ET AL.

It is certified that error appears in the above-identified patent and that said Letters Patent is hereby corrected as shown below:

Item

[57] ABSTRACT

Line 11, "polarity to" should read --polarity as--.

COLUMN 1

Line 54, "magent" should read --magnet--.

COLUMN 2

Line 20, "adapted" should read --adopted--.

COLUMN 3

Line 35, "regu-" should be deleted.
Line 36, "lation station of the" should be deleted.

UNITED STATES PATENT AND TRADEMARK OFFICE

CERTIFICATE OF CORRECTION

PATENT NO. : 5,581,336

DATED : December 3, 1996

INVENTOR(S) : SHIGERU MATSUZAKI ET AL.

It is certified that error appears in the above-identified patent and that said Letters Patent is hereby corrected as shown below:

COLUMN 5

Line 39, "if" should read --is--.

COLUMN 6

Line 62, "intends" should read --tends--.

COLUMN 7

Line 1, "16C" should read --16c--.
Line 9, "area 16C," should read --area 16c,--.
Line 46, "intends" should read --tends--.

COLUMN 9

Line 16, "rotatable" should read --rotatably--.

UNITED STATES PATENT AND TRADEMARK OFFICE

CERTIFICATE OF CORRECTION

PATENT NO. : 5,581,336

DATED : December 3, 1996

INVENTOR(S) : SHIGERU MATSUZAKI ET AL.

It is certified that error appears in the above-identified patent and that said Letters Patent is hereby corrected as shown below:

COLUMN 10

Line 4, "electrode 210," should read --pole N3--.

COLUMN 11

Line 62, "nonmagnetic" should read --non-magnetic--.

COLUMN 12

Line 9, "image" should read --image,--.

COLUMN 13

Line 9, "collide to" should read --collides with--.
Line 29, "down stream" should read --downstream--.
Line 34, "violately" should read --violently--.
Line 44, "lie down" should read --lie flat--.
Line 46, "violately should read --violently--.
Line 55, "Be>Br." should read Bθ>Br.--.

UNITED STATES PATENT AND TRADEMARK OFFICE

CERTIFICATE OF CORRECTION

PATENT NO. : 5,581,336

DATED : December 3, 1996

INVENTOR(S) : SHIGERU MATSUZAKI ET AL.

It is certified that error appears in the above-identified patent and that said Letters Patent is hereby corrected as shown below:

COLUMN 14

Line 12, "condition" should read --description--.
Line 47, "2$\mu$m" should read --2 mm--.

Signed and Sealed this

Twenty-fourth Day of June, 1997

Bruce Lehman

*Attest:*

BRUCE LEHMAN

*Attesting Officer*

*Commissioner of Patents and Trademarks*